United States Patent [19]

Ohuchi

[11] Patent Number: 4,846,779

[45] Date of Patent: Jul. 11, 1989

[54] TRAPEZOIDALLY SHAPED PAPER BAG AND METHOD AND APPARATUS FOR MANUFACTURING SAME

[75] Inventor: Yoshio Ohuchi, Osaka, Japan

[73] Assignee: Kabushiki Kaisha Showa Seimitsu Seitaiki Seisakusho, Osaka, Japan

[21] Appl. No.: 293,581

[22] Filed: Jan. 4, 1989

Related U.S. Application Data

[62] Division of Ser. No. 40,496, Apr. 20, 1987, abandoned.

[30] Foreign Application Priority Data

Apr. 22, 1986 [JP] Japan ..... 61-93063

[51] Int. Cl.[4] ..... B31B 25/22; B31B 25/54; B31B 25/28

[52] U.S. Cl. ..... 493/232; 493/153; 493/248; 493/253; 229/1.5 B

[58] Field of Search ..... 493/153, 229, 230, 231, 493/232, 233, 234, 235, 236, 237, 243, 246, 248, 250, 252, 253; 229/1.5 B

[56] References Cited

U.S. PATENT DOCUMENTS

| | | | |
|---|---|---|---|
| 64,537 | 5/1867 | Jaeger | 493/253 |
| 153,596 | 7/1874 | Muller | 493/253 |
| 1,010,833 | 12/1911 | West | 229/75 |
| 1,025,659 | 5/1912 | Vargyas et al. | 229/1.5 B |
| 1,034,879 | 5/1912 | Cooley | 493/253 |
| 1,144,950 | 6/1915 | Swift | 493/231 |
| 1,268,674 | 6/1918 | Brown | 493/229 |
| 1,470,172 | 10/1923 | Labombarde | 383/35 |
| 1,680,151 | 8/1928 | Kauffman | 383/84 |
| 1,720,497 | 7/1929 | Vierengel | 229/1.5 B |
| 1,790,415 | 1/1931 | Fischer et al. | 229/1.5 B |
| 1,851,061 | 3/1932 | Poppe | 493/235 |
| 1,940,406 | 12/1933 | Ericson | 229/1.5 B |
| 1,980,953 | 11/1934 | Kilmer | 383/35 |
| 2,058,501 | 10/1936 | Potdevin | 493/232 |
| 2,153,848 | 4/1939 | Shea et al. | 493/235 |
| 3,017,063 | 1/1962 | Rooney | 229/75 |
| 4,091,596 | 5/1978 | Jones | 493/232 |
| 4,789,350 | 12/1988 | Honsel | 493/232 |

FOREIGN PATENT DOCUMENTS

| | | | |
|---|---|---|---|
| 461 | of 1900 | United Kingdom | 383/35 |
| 23654 | of 1915 | United Kingdom | 493/253 |

*Primary Examiner*—Frederick R. Schmidt
*Assistant Examiner*—William E. Terrell
*Attorney, Agent, or Firm*—Mason, Fenwick & Lawrence

[57] ABSTRACT

Apparatus for manufacturing a trapezoidally-shaped paper bag comprises a cutting and processing device to form a continuous line of blanks in a paper strip, left and right guide rail units for raising up the side flaps of successive blanks, left and right folding ruler members arranged in an inverted V in the direction of advance of the paper strip, a base rod for causing forward and backward reciprocating movement of the left and right ruler members on the upper surface of the blank being processed between the guide rail units, and inwardly and outwardly reciprocating left and right sliding plates for folding up the side folding flaps of the blank by moving inwardly over the left and right ruler members, respectively, in an overlapping relation. A method for forming a trapezodially-shaped paper bag comprises forming a continuous line of paper blanks in an advancing, continuous paper strip, gradually raising up the side flaps of the blank being processed, holding down the center of the blank along oblique lines forming a trapezoid, and folding over the side flaps in a mutually overlapping relation.

3 Claims, 5 Drawing Sheets

TRAPEZOIDALLY SHAPED PAPER BAG AND METHOD AND APPARATUS FOR MANUFACTURING SAME

This application is a Division of application Ser. No. 040,496 filed Apr. 20, 1987 abandoned.

The present invention relates to a trapezoidally-shaped paper bag capable of use as a flat drinking cup, a test container for testing glycosuria, blood sputum and the like, and a chartula for medicine; to a method for continuously forming such a paper bag at high speed from a continuous paper roll; and to apparatus to be used for carrying out such method.

In the formation of a trapezoidally-shaped paper bag, it was heretofore common to form a strip of blanks for the bag by punching and processing the strip of blanks in the desired pattern using a cutting machine, partially folding up each blank, and pasting it using different flat paper bag manufacturing machines performing different steps to form a trapezoidally-shaped paper bag.

The manufacturing method and apparatus for continuously forming a symmetrical, triangular paper bag or a paper bag having a truncated cone shape in one step from two sheets of upper and lower continuous strips of paper of different width are disclosed in Japanese Patent Publication No. TOKUKOSHO 53-8263, published Mar. 27, 1978, in the name of the present inventor.

The method and apparatus for manufacturing a trapezoidally-shaped or truncated-cone shaped paper bag from a conventional strip of blanks needed several kinds of independent processing machines wherein many steps were involved for conveying, loading, and withdrawing the paper, and changing its direction of motion, which resulted in lowering the production efficiency. The paper bag production rate was as low as 80 to 100 bags per minute at best. In addition, a smaller bag of the same kind was extremely difficult to form and the production cost became expensive.

The aforesaid triangular or trapezoidally-shaped paper bag was prepared by employing two sheets of continuous strips of paper. However, the formation of such a paper bag from one continuous paper strip was quite impossible, because the provision of non-parallel oblique folding lines forming both side edges of the paper, the folding up of the edges in overlapping relation, and pasting of both edges required extremely difficult processes. Consequently, a trapezoidally-shaped paper bag from one continuous paper strip was deemed to be completely difficult to form.

SUMMARY OF THE INVENTION

The present invention was developed in view of the above-mentioned difficulties, and it is the object of the invention to provide a new and improved method and apparatus for manufacturing a trapezoidally-shaped paper bag automatically and efficiently at high speed from a single continuous paper strip.

This and other objects of the invention are achieved by provision of a trapezoidally-shaped paper bag manufactured by successively forming in a continuous, moving paper strip a continuous line of paper blanks each having continuous and integral formed upper and lower folding flaps. The center of each blank in turn is held down along oblique lines on an advancing path by left and right ruler members open in an inverted V shape, and both side flaps of the blank are folded upwardly and inwardly by left and right sliding plates reciprocally moveable from side to side. The side flaps are folded down in an overlapping relation and the edges pasted by means of a pasting line to form the trapezoidally-shaped paper bag having left and right oblique folds on both sides thereof. The partially-made paper bags are cut between the upper and lower folding flaps by an ordinary cutting means, and the lower folding flap is pasted and folded up to close its bottom. One or more fold lines are provided downwardly to the bottom of the upper folding flap.

Apparatus according to the invention for manufacturing a trapezoidally-shaped paper bag as described above comprises a cutting and processing device to form a continuous line of blanks in a paper strip, each blank having continuous and integral formed upper and lower folding flaps at a regular, spaced interval on both ends of the blank and left and right side folding flaps, a pasting member for pasting an outer side edge of one of the side folding flaps of the blank, left and right guide rail units for raising up the side folding flaps of successive blanks, left and right ruler members arranged in an inverted V in the direction of advance of the paper strip, and a base rod for causing forward and backward reciprocating movement of the ruler members on the upper surface of the blank between the guide rail units. The ruler members are pivotably mounted at their forward ends by a pivot support member mounted on the base rod. On the upper surface of the left and right ruler members, there are provided left and right rails, respectively, having face-to-face tapered surfaces and connected to each other at their rearward ends by a spring or similar return biasing member for opening and closing the ruler members in a fixed, initial angle in cooperation with the forward and backward reciprocating movement of the base rod and the ruler members. The length of backward and forward movement of the base rod is freely adjustable from the zero or stationery position up to about a half length of the paper bag formed, according to the quality and thickness of the paper.

In addition, left and right sliding plates are symmetrically disposed left and right of the left and right ruler members in a manner capable of folding up both of left and right side folding flaps, respectively, by moving inwardly over the ruler members in an overlapping relation simultaneously with the forward movement and opening of the left and right ruler members, respectively. The sliding plates move outwardly following the rearward and closing movement of the ruler members. Upper and lower press rollers are disposed forward of the sliding plates for pasting the overlapping portions of the side folding flaps.

In the operation of the apparatus, the continuous paper strip is transferred forwardly, through a cutting and processing device to form a continuous line of blanks. A pasting line is provided by a pasting member along an outer side edge of one of the side folding flaps of each blank. As each blank is conveyed forwardly, the side folding flaps are raised up by the left and right guide rail units. The left and right ruler members are fixed to the base rod for backward and forward reciprocating movement on the surface of the blank between the guide rail units. At the time of the synchronized forward movements of the base rod and the continuous paper strip, the ruler members are opened by an immoveable supporting shaft or bearing extending through the base rod by the action of the shaft against the left and right rails. The central portion of the blank of the paper bag is thereby held down. Simultaneously, the left and right sliding plates are made to move inwardly in a manner overlying the left and right ruler members, respectively, and the side folding flaps are provided with slanting folds at both sides of the blank along the folding ruler members and are folded up. In conjunction with the forward movement of the continuous paper strip, the side folding flaps are folded up, overlapped, and bonded between upper and lower press rollers. Thereafter, the upper and lower folding flaps are severed between bags by a paper bag manufacturing process similar to that carried out by known paper bag manufacturing machines, and the lower folding flap is folded and glued, and the trapezoidally-shaped paper bag is continuously manufactured.

A method for manufacturing a trapezoidally-shaped paper bag according to the invention as described above is achieved by the steps of gradually forming a continuous line of paper blanks in an advancing, continuous paper strip, each blank having continuous and integral upper and lower folding flaps formed at a regular, spaced intervals on both ends and left and right side folding flaps by means of a cutting and processing device equipped with an edged tool or a rotary cutting blade. As the line of blanks is continuously conveyed forwardly, each blank in turn is formed into a bag by gradually raising up both side flaps of the blank, and holding down the center of the blank along oblique lines forming a trapezoid using left and right ruler members disposed on an upper central surface of the advancing path of the paper blank. The forward and backward reciprocating movement of the ruler members is freely adjustable up to about a half length of the paper bag from the zero or stationery position, according to the quality and thickness of the paper. The ruler members are opened along both side edges of the paper bag in synchronization with the forward movement of the ruler members and the continuous paper strip. Simultaneously, the forward ends of left and right sliding plates move inwardly to slide over the left and right ruler members, respectively, in an overlapping relation, whereupon left and right slanting folds, respectively, are formed on both sides of the blank in alignment with the advancing movement of the continuous paper strip, the left and right side folding flaps are folded up inward in a mutually overlapping relation, and are pasted together by upper and lower press rollers, whereby the paper bag is formed and delivered.

DESCRIPTION OF THE PREFERRED EMBODIMENT

Figure 1:
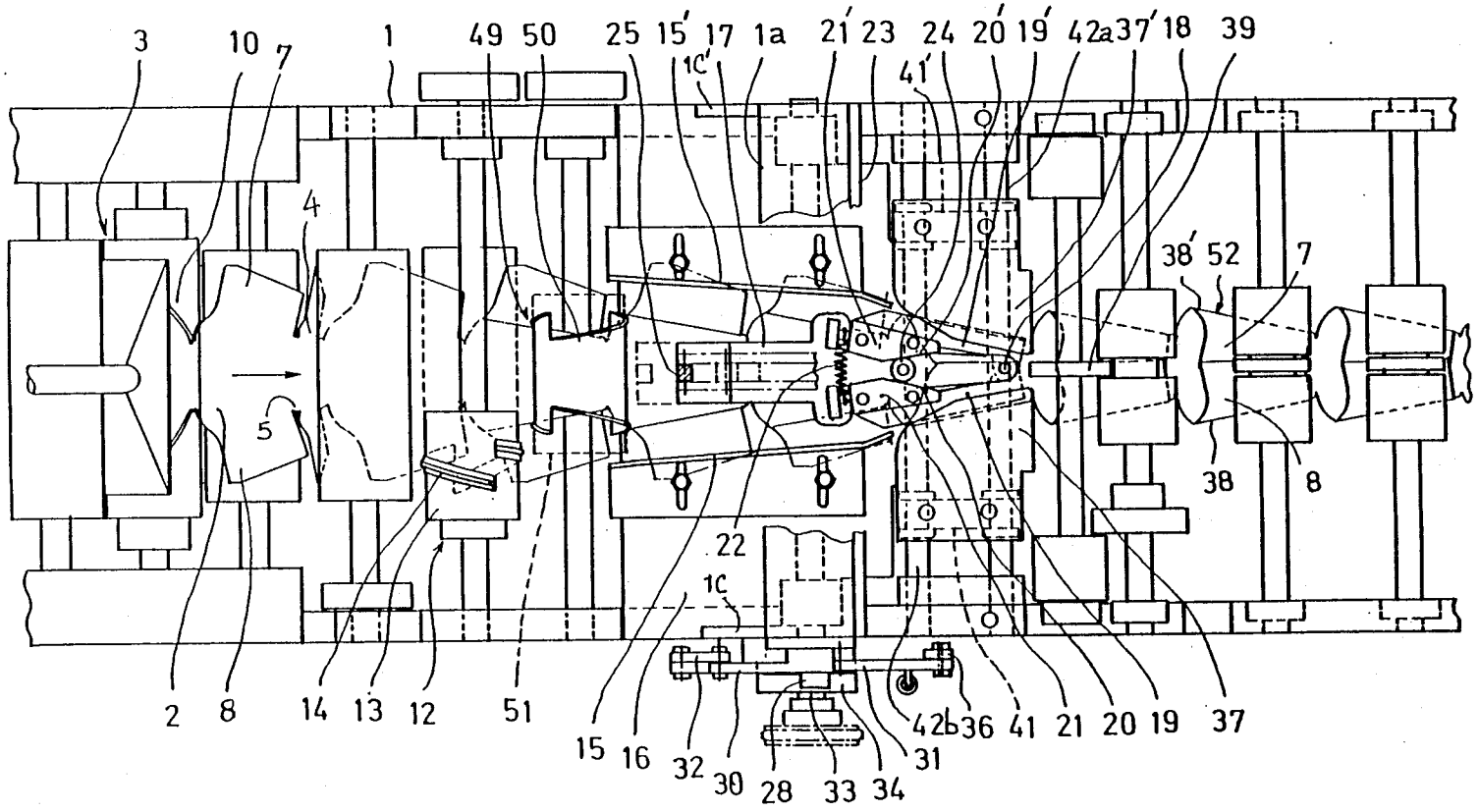
FIG. 1 is a top plan view of apparatus for forming a paper bag according to the invention.
Figure 2:
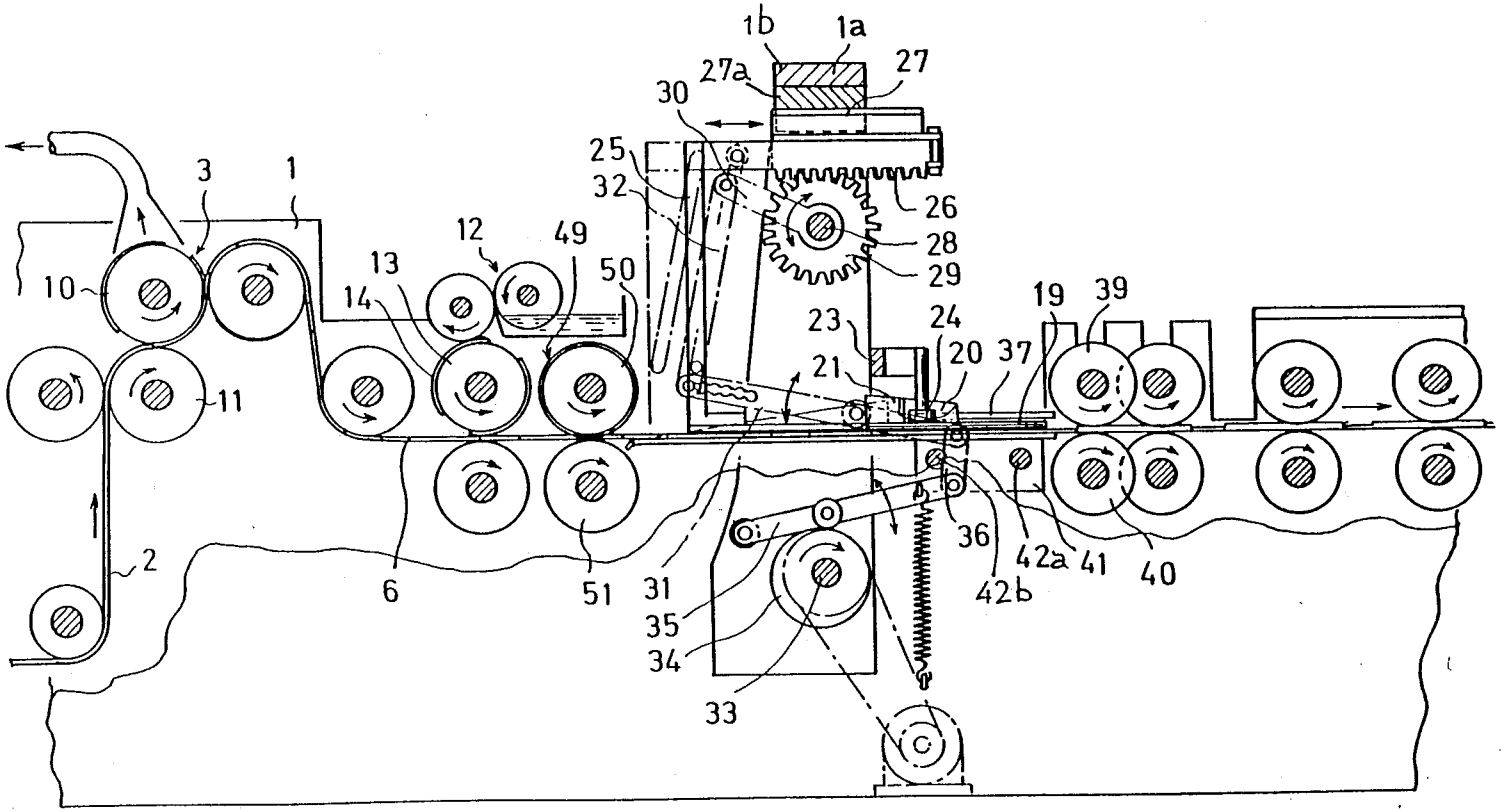
FIG. 2 is a left side elevational view of the apparatus of FIG. 1, with parts cut away.
Figure 3:
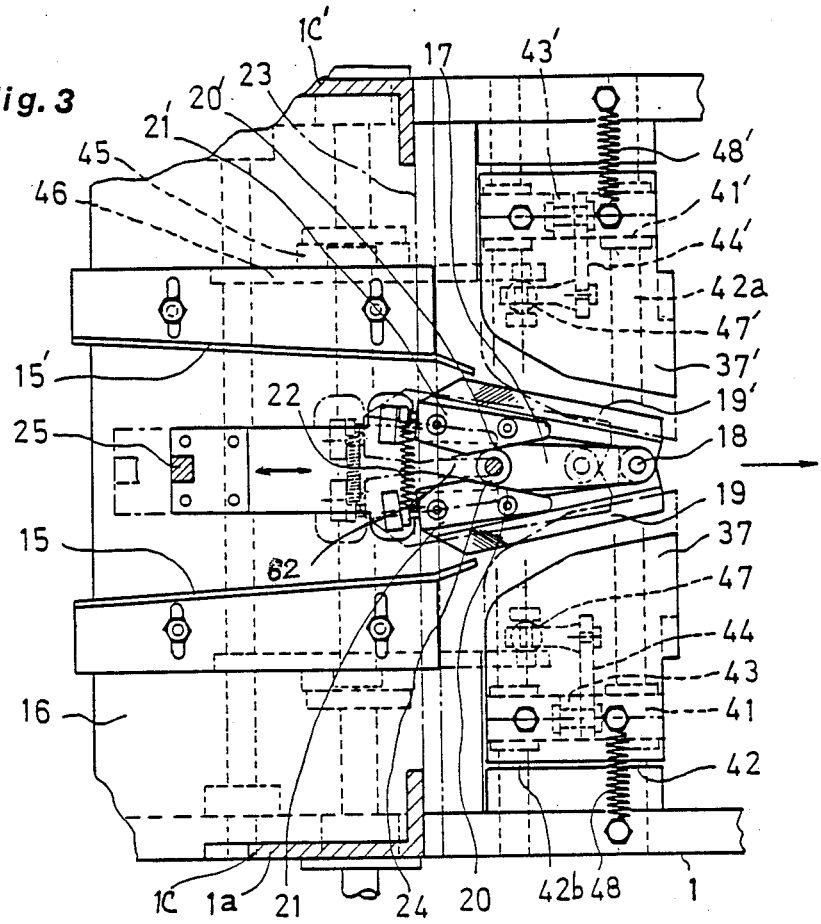
FIG. 3 is an enlarged view of a portion of the apparatus shown in FIG. 1.
Figure 4:
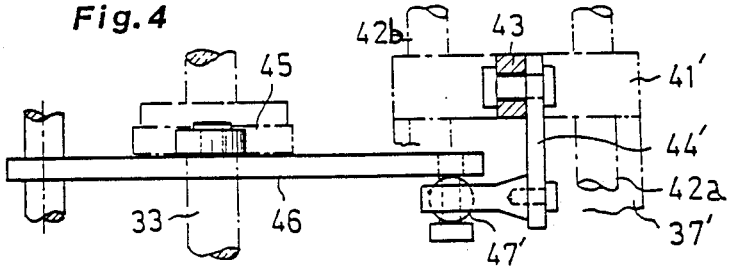
FIG. 4 is an enlarged view of the upper right portion of FIG. 3.
Figure 5:
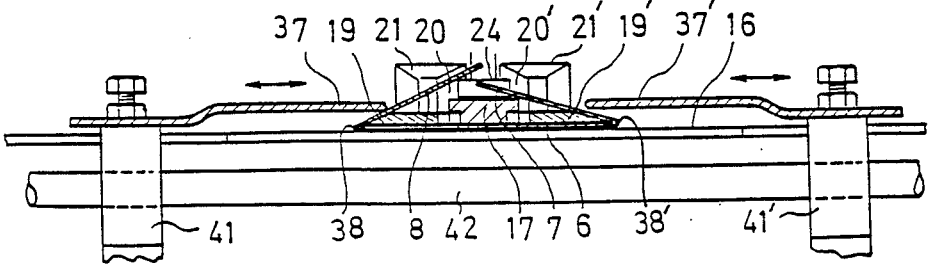
FIG. 5 is a front elevational view of the apparatus shown in FIG. 3.

An embodiment of the present invention will be explained in accordance with FIG. 1–9 of the accompanying drawings. Referring now to FIGS. 1 and 2, there is shown a machine frame 1 of a device for manufacturing a trapezoidally-shaped paper bag 52, a continuous paper strip 2 being continuously conveyed forwardly, and a cutting and processing device 3 for preparing a line of paper blanks 6 in paper strip 2.

Machine frame 1 includes an arch portion la comprising a cross bar 1*b* (shown in FIG. 6) positioned above machine frame 1 perpendicular to the direction of travel of paper strip 2, and left and right vertical arms 1*c* and 1*c'* for supporting cross bar 1*b* over machine frame 1. Each formed blank 6 has continuous and integrally formed upper and lower flaps 4 and 5 and right and left side folding flaps 7 and 8 at regular, spaced intervals. Paper pattern cutting device 3 comprising a rotary cutting blade 10 and an anvil roller 11 (shown in FIG. 2), is employed to form blanks 6 in paper strip 2. The cutting device 3 was developed, invented, and created by the present inventor and disclosed in Japanese Patent Publication No. TOKUKOSHO 52-11255, published Mar. 30, 1977, and Japanese Utility Model Publication No. JITSUKOSHO 53-7927, published Feb. 28, 1978. The blanks 6 each paper bags 52 are formed individually when continuous paper strip 2 passes through cutting device 3 between cutting blade 10 and anvil roller 11.

A pasting device 12, comprising a pasting roller 13 disposed on machine frame 1 and a pair of projecting members 14 disposed diametrically opposite each other around the circumference of pasting roller 13 at an angle to the longitudinal axis of pasting roller 13, is arranged to provide a pasting line 9 along the outer edge of folding side flap 8 of each blank 6. Pasting device 12 applies a paste by means of one of projecting members 14.

Each blank 6 in turn is moved forward onto a base plate 16 disposed centrally in machine frame 1, where it is formed into a paper bag 52 by the combined action of left and right guide rail units 15 and 15', left and right ruler members 19 and 19', and left and right sliding plates 37 and 37'. Left and right guide rail units 15 and 15' are arranged symmetrically on both sides of base plate 16, and press upwardly on folding flap 8 and 7, respectively, to make them stand up. Guide rail units 15 and 15' comprise a pair of oblique plates the height of each of which increases and the space between which decreases in the forward direction, that is, the direction of travel of paper strip 2.

A base rod 17 is disposed above base plate 16 to reciprocate regularly forwardly and backwardly on top of the blank 6 currently being processed, at the midpoint between guide rail units 15 and 15'. Left and right ruler members 19 and 19' are disposed on either side of left and right rail units 15 and 15', respectively, and are pivotably supported at their forward ends on a pivot support member 18 fixedly mounted to the forward end of base rod 17. Left and right ruler members 19 and 19' are arranged in an inverted V shape with respect to the direction of movement of paper strip 2. The rearward upper surfaces of ruler members 19 and 19' are provided with left and right rails 21 and 21', respectively, having respective opposed, tapered inner surfaces 20 and 20'. The rearward end of rails 21 and 21' are connected to each other by a return spring 22 or similar biasing means.

A supporting rod 23 is disposed transversely of machine frame 1 above the forward ends of guide rail units 15 and 15'. A fixed shaft or bearing 24 extends perpendicularly upwardly from base plate 16 forwardly of the center of supporting rod 23 through a longitudinal aperture 62 in base rod 17, for engagement with tapered surfaces 20 and 20' of rails 21 and 21'.

Figure 6:
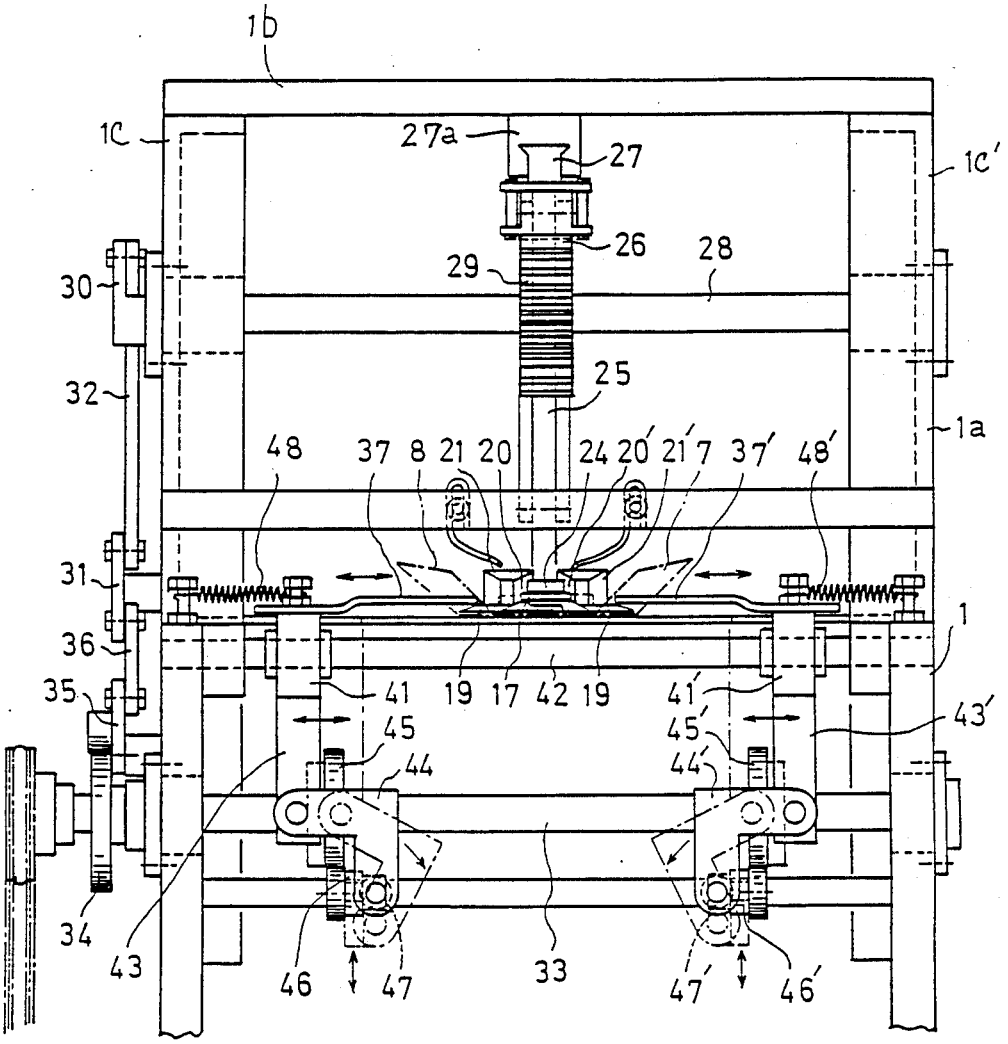
FIG. 6 is a front elevational view of the apparatus shown in FIG. 1.
Figure 7:
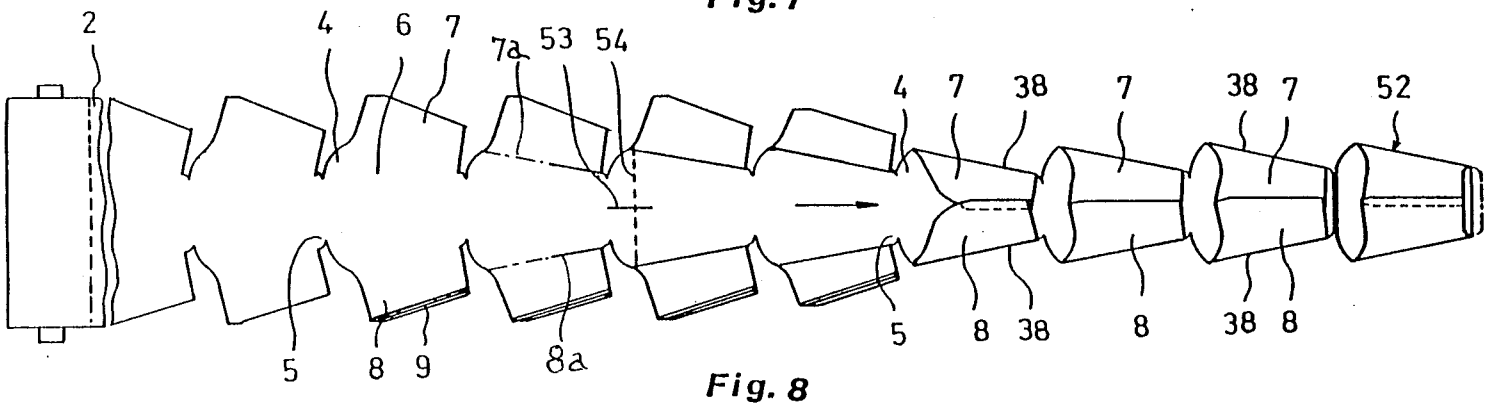
FIG. 7 is a top plan view of a line of blanks formed in a continuous paper strip, the blanks being formed into a paper bag according to the method of the invention.
Figure 8:
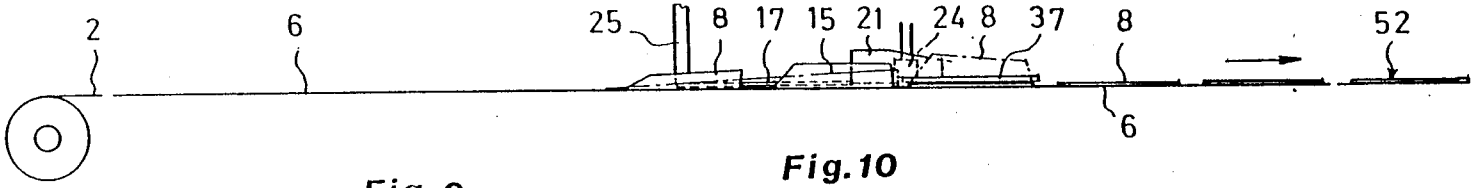
FIG. 8 is a left side elevational view of FIG. 7.

As base rod 17 moves forward, the action of shaft 24 against tapered surfaces 20 and 20' forces tapered surfaces 20 and 20' apart, opening ruler members 19 and 19' into an inverted V at a fixed, initial angle at pivot support member 18. A mechanism for controlling the forward and backward reciprocal movement of base rod 17 and ruler members 19 and 19' is shown in FIGS. 2 and 6. An inverted L-shaped rod 25 is attached to the rear of base rod 17, and a horizontal rack 26 is positioned above the forward end of base rod 17. Rack 26 is provided on its upper portion with a horizontal guide member 27. Guide member 27 is slideably mounted in an elongate sleeve **27*a* mounted under crossbar 1*b* of machine frame arch portion 1*a*. Rack 26 matingly engages a pinion gear 29 rotatably mounted on a transmission shaft 28. Transmission shaft 28 is itself mounted between arms 1*c* and 1*c*'beneath and spaced apart from crossbar lb of machine frame arch portion 1*a*. An arm 30 fixedly extends perpendicularly from one end of transmission shaft 28. Lever 31 is pivotably supported on arm 1*c* of machine frame arch portion la and is connected at one end to arm 30 by a connecting rod 32. At its other, forward end, lever 31 is connected to the forward end of a lever 35 by a linkage rod 36. Rod 36 is moved up and down by a cam plate 34. Cam plate 34 is eccentrically mounted on a driven shaft 33 rotatably mounted on machine frame 1 perpendicular to the direction of travel of paper strip 2. Base rod 17 is thereby driven to make one reciprocating backward and forward movement for each rotation of main shaft 33, and is allowed to advance at a speed synchronized with that of the advancing movement of paper strip 2**.

Also, the length of the backward and forward reciprocating movement of base rod 17 and ruler members 19 and 19' is freely adjustable from the zero or stationery position up to about a half length of the paper bag formed, according to the quality and thickness of the paper. To this end, the rearward ends of arm 30 and lever 31 are each provided with an elongate aperture (not shown on arm 30) for fixedly adjusting the position of the rearward ends of arm 30 and lever 31 with respect to connecting rod 32. Also, the other, forward end of lever 31, the forward end of lever 35, or linkage rod 36 is provided with an elongate aperture, and the connection point of lever 31, lever 35, and the linkage rod 36 can be fixedly adjusted at an alternate position. By adjusting the angle of rotation of arm 30, the amount of forward and backward reciprocating movement and the opening angle of folding ruler members 19 and 19' can be adjusted.

Left and right sliding plates 37 and 37' are mounted on machine frame 1 on either side of left and right ruler members 19 and 19', respectively, for inward and outward reciprocating movement overlapping the forward ends of ruler members 19 and 19' simultaneously with the forward movement of ruler members 19 and 19'. The center portion of the blank 6 being processed is held down by ruler members 19 and 19' along oblique lines **8*a* and 7*a* defining the inner edges of side flaps 8 and 7, respectively, to form a trapezoid. Ruler members 19 and 19' move forwardly in conjunction with the forward movement of the paper strip 2. Simultaneously, side flaps 8 and 7 are folded over ruler members 19 and 19', respectively, by the inward movement of sliding plates 37 and 37', forming oblique left and right folds 38 and 38' in blank 6 side flaps 7 and 8 are then overlapped and pasted by paired press rollers 39 and 40**.

Referring now to FIGS. 3–6, the mechanism for causing the reciprocating movement of sliding plates 37 and 37' is shown. Forward and rearward guide shafts **42*a* and 42*b* are fixedly mounted on machine frame 1 perpendicular to the direction of movement of paper strip 2. Sliding plates 37 and 37' are mounted for inward and outward reciprocating movement on forward and rearward guideshafts 42*a* and 42*b* by means of left and right fixing bases 41 and 41', respectively. Left and right arms 43 and 43' are suspended at their upper ends from fixing bases 41 and 41', respectively. Arms 43 and 43' are pivotably connected at their lower ends to one leg of left and right dogleg arms 44 and 44', respectively. Left and right cam plates 45 and 45' are symmetrically fixed to an inner portion of main shaft 33 by left and right ball joints 47 and 47', respectively. Left and right levers 46 and 46' are driven up and down by cam plates 45 and 45', respectively, and are connected to the other legs of dogleg arms 44 and 44', respectively. Levers 46 and 46' move up and down once for each rotation of main shaft 33, while dogleg arms 44 and 44' rotate around ball joints 47 and 47' as shown by the solid and dashed lines in FIG. 6, causing sliding plates 37 and 37', respectively, to advance inwardly towards each other. Sliding plates 37 and 37' are returned to their starting positions by left and right springs 48 and 48' connected at one end to sliding plates 37 and 37', respectively, and at their other ends to machine frame 1. The inward movement of sliding plates 37 and 37' over ruler members 19 and 19' result in the formation of oblique side edge folds 38 and 38', respectively, and the folding over of side flaps 8 and 7**, respectively.

Referring again to FIGS. 1 and 2, a fold-forming device 49 comprises a paired fold-forming roller 50 and a supporting roller 51 mounted on machine frame 1. Fold-forming device 49 forms oblique folds spaced from the oblique side edges of each blank 6. In the case of paper which is thick or otherwise difficult to fold in a straight line, oblique folds 38 and 38' forming the side edges of the trapezoidally-shaped paper bag are provided. Thereby, the folding up and overlapping of the side edges by ruler members 19 and 19' and sliding plates 37 and 37' can further be carried out without any difficulty.

Figure 10:
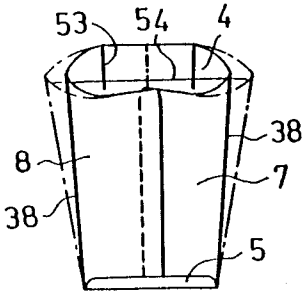
FIG. 10 is a top plan view showing a second embodiment of a trapezoidally-shaped paper bag manufactured by the method and apparatus of the present invention.
Figure 9:
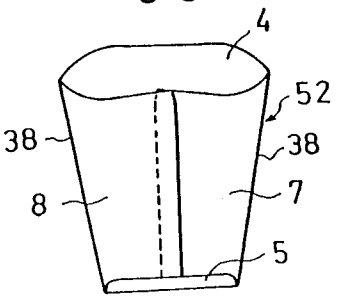
FIG. 9 is a top plan view showing a first embodiment of a trapezoidally-shaped paper bag manufactured by the method and apparatus of the present invention.

In addition, one or more fold-forming short projections (not shown) and a transverse line (not shown) can be provided at the circumference of the central portion of fold-forming device 49 to create folds or creases 53 and 54 in the upper portion of the formed, trapezoidally-shaped paper bag 52, as shown in FIG. 10. The mouth of the paper bag 52 can then be easily opened by pressing inwardly by hand on both sides of the paper bag, and an object put into the bag. When th upper folding flap is made to protrude and is folded down and inserted into a cut made in the bag, bag 52 can be sealed.

The trapezoidally-shaped paper bag 52 according to the invention can be formed from a continuous strip 2 of vegetable fiber paper, paraffin paper, cellophane paper, and the like by the apparatus of the present invention, although it was hitherto considered to be impossible to manufacture such a paper bag. Moreover, the mass production of such a paper bag is possible at the maximum efficiency in conformity with the forward speed of the continuous paper strip 2. The present production rate is 450 bags per minute, based on the use of the ball bearing slide unit for linear motion disclosed in U.S. Pat. No. 4,390,215. However, if the capabilities of this ball bearing slide unit are improved further, the production capacity of the apparatus of the invention will be further increased, and it will be possible to provide the trapezoidally-shaped paper bag easily and simply at a lower cost.

In the method according to the invention, a trapezoidally-shaped paper is formed by the steps of gradually forming a continuous line of paper blanks in an advancing, continuous paper strip 2, each blank 6 having continuous and integral upper and lower folding flaps 4 and 5 formed at a regular, spaced interval on both ends and left and right side folding flaps 8 and 7 by means of cutting and processing device 2 equipped with an edged tool or a rotary cutting blade 10. As the line of blanks 6 is continuously conveyed forwardly, each blank 6 in turn is formed into a bag 52 by gradually raising up both side flaps 8 and 7 of blank 6, and holding down the center of the blank along lines 8*a* and 7*a*, defining the inner edges of flaps 8 and 7, respectively, to form a trapezoid using left and right ruler members 19 and 19' disposed on and moving forwardly with the upper central surface of the advancing path of the paper blank 6. The forward and backward reciprocating movement of ruler members 19 and 19' is freely adjustable up to about a half length of the paper bag from the zero or stationery position, according to the quality and thickness of the paper. Ruler members 19 and 19' are opened along both side edges of the paper bag in synchronization with the forward movement of ruler members 19 and 19' and continuous paper strip 2. Simultaneously, the forward ends of left and right sliding plates 37 and 37' reciprocate from left to right to slide over the left and right ruler member 19 and 19', respectively, in an overlapping relation, whereupon left and right slanting folds, respectively, are formed on both sides of blank 6 in alignment with the advancing movement of continuous paper strip 2, and left and right folding side flaps 8 and 7 are folded down inward by upper and lower press rollers 39 and 40, whereby the paper bag is formed and delivered.

Thus, the trapezoidally-shaped paper bag of the invention can be manufactured without irregularity in size and can be supplied as a uniform product. Further, if the continuous paper strip 2 is made from a water-repelling material or water-proof laminated paper, a leak-proof paper bag can be produced inexpensively.

Thus, it will be seen that the present invention provides a unique method and apparatus for forming a trapezoid- ally-shaped paper bag. While a preferred embodiment of the invention has been disclosed, it should be understood that the spirit and scope of the invention is to be limited solely by the appended claims, since numerous modifications of the disclosed embodiment will undoubtedly occur to those of skill in the art.

I claim:

1. Apparatus for manufacturing trapezoidally-shaped paper bags from a continuous paper strip, comprising:

frame means having a forward end and a rearward end;

cutting and processing means disposed on said rearward end of said frame means for forming in the continuous paper strip a continuous line of blanks having continuous and integral upper and lower folding flaps and left and right side folding flaps at regular, spaced intervals;

left and right guide rail unit means mounted on said frame means forwardly of said cutting and processing means for gradually raising up said left and right side folding flaps, respectively;

left and right ruler means provided at the forward ends of said guide rail unit means, intermediate said guide rail unit means, on the upper surface of the continuous paper strip, for holding down the center of the blank being processed along oblique lines forming a trapezoid, the rearward ends of said left and right ruler means being open in an inverted V, and said left and right ruler means including left and right rail means having opposed, tapered surfaces provided at an upper surface of said left and right ruler means, respectively;

base rod means disposed between said guide rail unit means and extending forwardly of said guide rails unit means;

pivot support means disposed at the forward end of said base rod means for pivotably mounting the forward ends of said left and right ruler means;

first reciprocation means for causing said base rod means and said left and right ruler means to make backward and forward reciprocating movements from a stationery position up to about a half length of the paper bag formed, according to the quality and thickness of the paper strip;

fixed shaft means extending through an aperture in said base rod means and fixedly positioned intermediate said tapered surfaces of said left and right rail means for forcing apart said tapered surfaces and causing said left and right ruler means to open when said base rod means moves forwardly;

return biasing means connected between said rail means for returning said left and right ruler means to an initial opening angle at the time of rearward movement;

left and right sliding plate means mounted on said frame means on either side of said left and right ruler means, respectively, for inward and outward reciprocating movement over said left and right ruler means for folding the side folding flaps of the blank being processed in overlapping relation to form a trapezoidally-shaped paper bag; and second reciprocation means for causing said left and right sliding plate means to move inwardly to overly said left and right ruler means, respectively, as said left and right ruler means open and advance forwardly, and for causing said left and right sliding plate means to move outwardly subsequent to the backward movement of said left and right ruler means.

2. The apparatus of claim 1 further comprising pasting means mounted on said frame means intermediate said cutting and processing means and said left and right guide rail unit means, for placing an adhesive on one of said side folding flaps.

3. The apparatus of claim 1, further comprising roller means disposed on said frame means forwardly of said sliding plate means for forming folds on the sides of the paper bag.

* * * * *